United States Patent [19]

Melcher

[11] 4,073,410

[45] Feb. 14, 1978

[54] CONSTRUCTION FILLER MATERIAL DISPENSING APPARATUS

[76] Inventor: Herbert R. Melcher, P.O. Box 109, Pound, Wis. 54164

[21] Appl. No.: 721,472

[22] Filed: Sept. 8, 1976

[51] Int. Cl.[2] ..... B67D 5/06

[52] U.S. Cl. ..... 222/181

[58] Field of Search ..... 222/181; 294/69, 69 S, 294/70, 71, 72, 73; 214/1 GD

[56] References Cited

U.S. PATENT DOCUMENTS

| | | | |
|---|---|---|---|
| 763,391 | 6/1904 | Hains et al. | 294/71 |
| 2,199,520 | 5/1940 | Dempster | 294/68 X |
| 2,541,261 | 2/1951 | Martinson | 294/68 |
| 3,414,312 | 12/1968 | Garlinghouse | 294/71 |

*Primary Examiner*—Allen N. Knowles
*Attorney, Agent, or Firm*—Harry C. Engstrom; Theodore J. Long

[57] ABSTRACT

Apparatus having a rectangular hopper converging downwardly to a bottom opening. A rectangular support frame supports the hopper on the ground to allow loading of filler material into the hopper by a front end loader tractor. A hanger suspends the hopper and frame above the ground when the hanger is engaged by an overhanging vertical support, such as a back-hoe or power shovel. The suspended apparatus may be inserted into a trench. A lever is connected through a linkage to a slide gate covering the bottom opening, and is manipulated by an operator to selectively move the slide gate to control discharge of filler material through the bottom opening.

4 Claims, 5 Drawing Figures

CONSTRUCTION FILLER MATERIAL DISPENSING APPARATUS

BACKGROUND OF THE INVENTION

1. Field of the Invention

This invention pertains generally to the field of material dispensing equipment and more particularly to equipment for holding and discharging construction filler materials into trenches.

2. Description of the Prior Art

It is common practice when laying sewer lines or piping in trenches to provide a bedding of gravel or crushed rock for the pipes. Back filling of piping in trenches with sand, gravel, or crushed rock is also common to provide satisfactory drainage around the pipe and additional solid structural support thereto.

It is preferred that a fairly even layer of gravel or rock be laid under the pipe before the pipe has been emplaced in the trench, and that a further uniform layer of gravel or rock be placed around the pipe before the trench is filled. This has commonly been accomplished by manual shoveling of the stone or gravel into the trench, or by the use of a power shovel or "backhoe" which scoops a load of the filler material from an adjacent pile and delivers this material into the trench where it is dumped. Generally, substantial additional hand leveling and spreading of the material in the trench is required. A substantial portion of the filler material is lost in transferring the material from the pile, where it has been dumped by a supply truck, to the trench, because of the inevitable spillage that occurs when such loose flowing material is carried over either by hand or by a power shovel. The power shovel bucket also tends to disperse the filler material as it scoops into it. High quality filler material such as gravel and crushed rock is relatively expensive, and the loss of this material by dispersal as described above adds significantly to the cost of construction.

Where precise placement of the filler material in the trench is not essential, a front end loader type of tractor is sometimes utilized to simply scoop up a load of filler material, and deposit it into the trench in the proper place. However, this method of providing filling and bedding material to the trench is often not feasible because of the danger of driving the front end loader too close to the side walls of the trench and collapsing the walls. Generally, the end loader tractor simply deposits the filling material at the side of the trench, from where it is manually shoveled into the trench. A substantial portion of the filler material is also lost by this method because it is scattered on the ground at the sides of the trench.

SUMMARY OF THE INVENTION

The material dispensing apparatus of my invention may be utilized to controllably dump filler material such as sand, gravel, or crushed stone into a trench in a desired position, while minimizing the spillage and dispersal of filler material during the operation. My dispensing apparatus is designed to be self-supporting on the ground, and is shaped and sized to allow a front end loader tractor to load a hopper portion of my apparatus with filler material. The hopper is rectangular in shape, having a longitudinal dimension which is preferably at least as wide as the standard bucket of a front end loader tractor, and having a lateral or short dimension which is substantially narrower to allow insertion into relatively narrow trenches. The rectangular hopper converges downwardly to a discharge opening which is selectively covered and closed by a sliding gate. A support frame is mounted to the hopper and provides support for it when the support frame is resting on the ground. A rectangular base of the support frame extends laterally outward beyond the top of the hopper to provide greater lateral stability when the frame is supporting the hopper. The outward extending base also maintains the hopper away from the side walls of a deep trench, thereby minimizing accidental dislodging of material from the trench sides and providing a safety margin for workers in the trench.

The discharge of filler material from the hopper may be controlled by an operator to dispense a controlled amount of material at any chosen spot in the trench. The sliding gate slides from a fully closed position covering the hopper bottom opening, wherein no material is discharged, through partially open positions in which selected amounts of material are discharged, to a fully open position in which a maximum amount of material will be discharged. The sliding gate is attached through a linkage mechanism to a pivotally mounted lever which may be moved by the operator to control the amount of material discharged. A hanger is mounted to the top of the hopper and is adapted to engage with an overhanging vertical support, such as a hook held by a back hoe or other similar power lifting device, to suspend the hopper and support frame. The dispensing apparatus may then be carried by the back hoe to the spot in the trench where the filler material is to be dumped, and an operator can manipulate the lever to discharge a controlled amount of filler material into the trench.

Further objects, features, and advantages of my invention will be apparent from the following detailed description, taken in conjunction with the accompanying drawings, showing a preferred embodiment of a construction filler material dispensing apparatus exemplifying the principles of my invention.

DESCRIPTION OF THE PREFERRED EMBODIMENT

Figure 1:
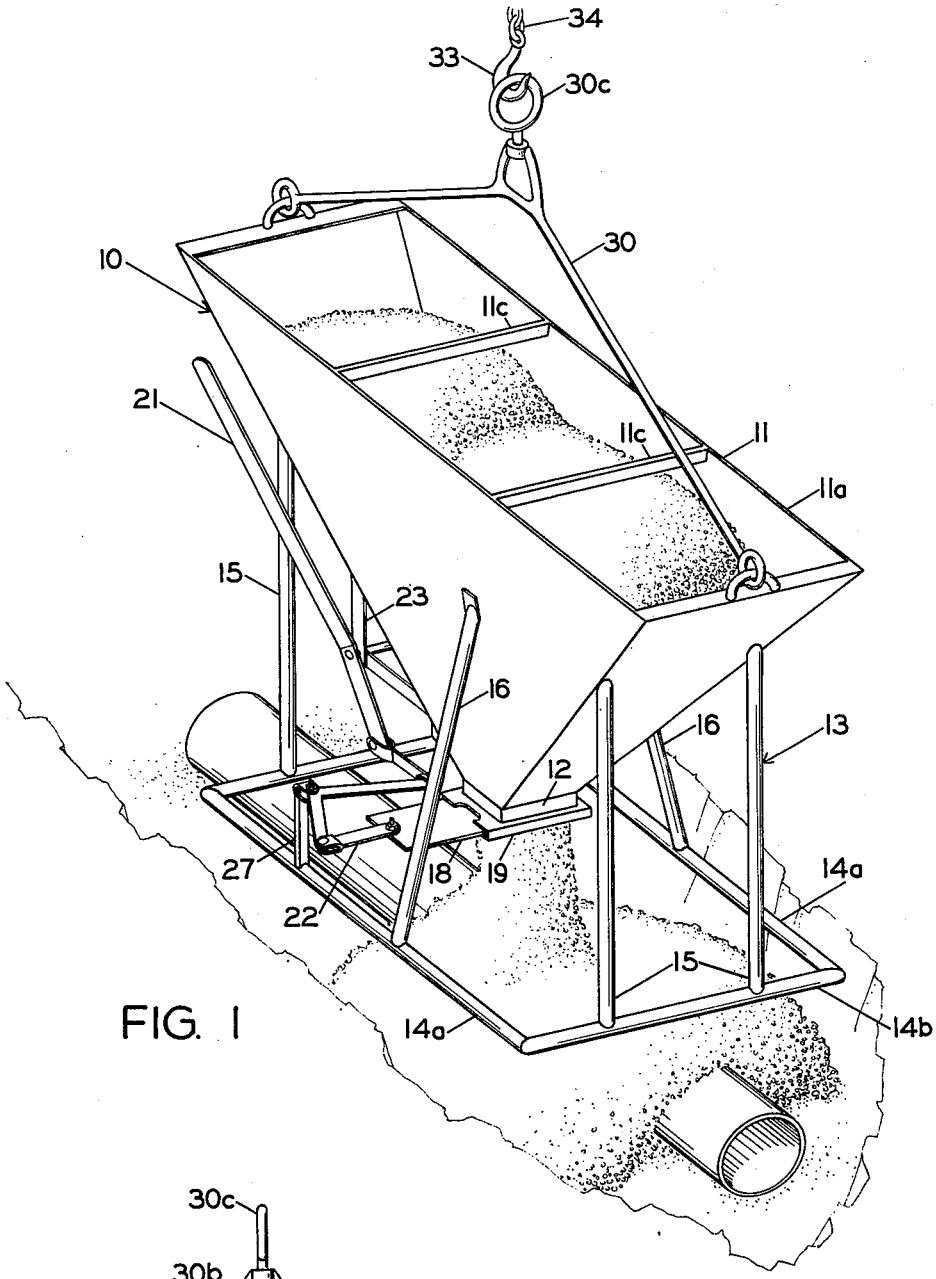
FIG. 1 is an isometric view showing my dispensing apparatus discharging filler material into a trench shown for illustrative purposes.
Figure 2:
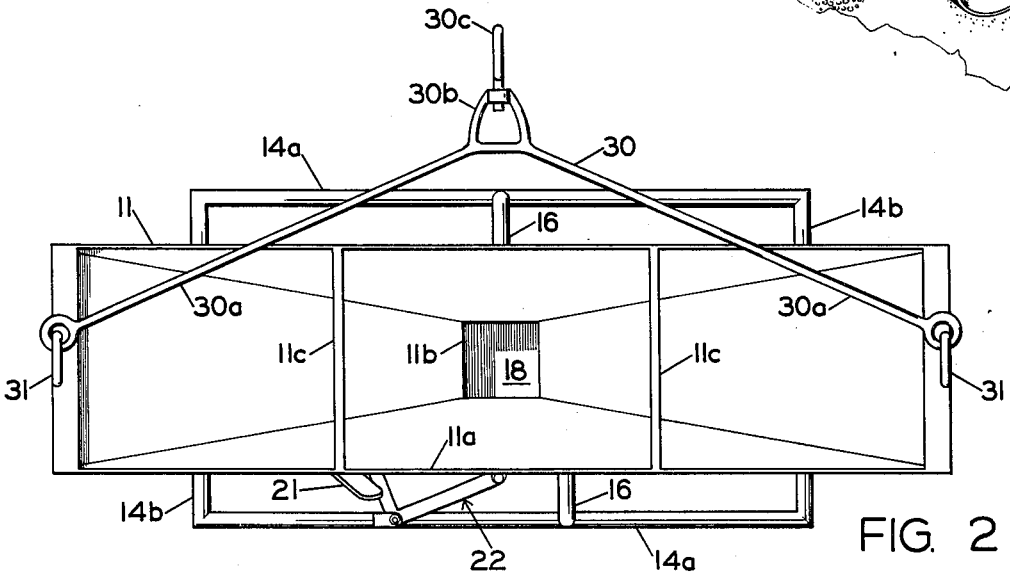
FIG. 2 is a top plan view of the dispensing apparatus of FIG. 1.
Figure 3:
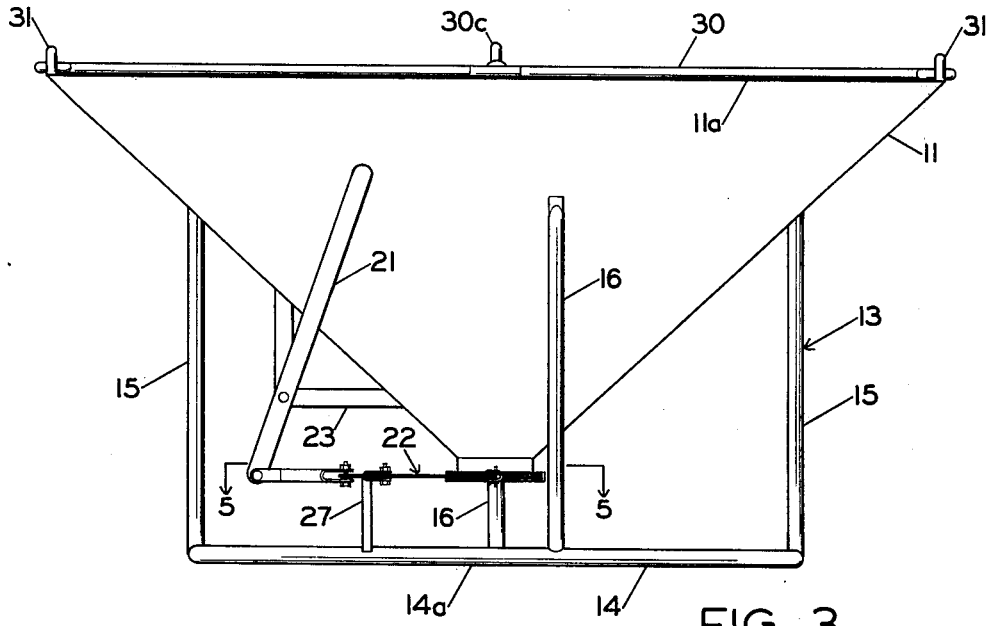
FIG. 3 is a side view of the dispensing apparatus of FIG. 1.

Referring now more particularly to the drawings, in which like numerals refer to like parts throughout the several views, a preferred embodiment of my construction filler material dispensing apparatus is shown generally at 10 in FIG. 1. The dispensing apparatus is shown in FIG. 1 in position to dispense construction filler material into a trench. A back-hoe, crane, or power shovel would be utilized to lift my dispensing apparatus from the portion of chain shown in FIG. 1, but such lifting equipment is not a part of my invention and is not shown in FIG. 1 for purposes of simplification. The operation of my dispensing apparatus will be further described below.

The construction material dispensing apparatus 10 includes a rectangular hopper 11 for holding the flowable construction filler material such as sand, gravel, crushed rock and so forth. The hopper 11 converges from its open top 11*a* downwardly to a discharge opening 11*b* at the bottom thereof. A guide chute 12 is preferably formed around the discharge opening 11*b* and attached to the bottom of the hopper to aid in guiding the discharged filler material downwardly.

Figure 4:
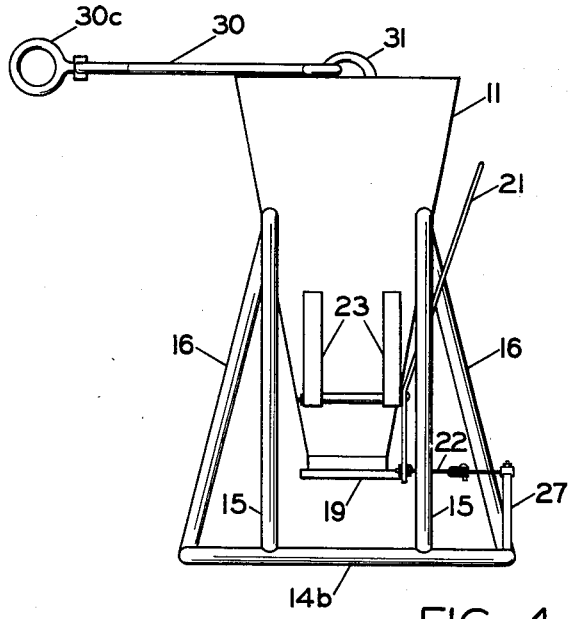
FIG. 4 is an end view of the dispensing apparatus of FIG. 1.

The longer or longitudinal dimension of the hopper 11 is substantially greater than the side or lateral dimension. The longitudinal dimension of the rectangular hopper is preferably chosen to be greater than the width of the bucket of a standard front end loader tractor. The longitudinal dimension of the hopper will generally thus be chosen to be at least six feet. However, it is necessary that the dispensing apparatus 10 be capable of being inserted into trenches where sewer pipe and the like are being laid. Thus, the lateral dimension of the hopper is preferably substantially less than the longitudinal dimension, and is preferably in the range of three feet or less. The hopper preferably converges inwardly, from top to bottom from all of the sides, to the relatively smaller dimensions of the discharge opening 11*b*, as shown in FIG. 4. The small size of the discharge opening 11*b* is preferred to allow a relatively narrow stream of filler material to be discharged from the hopper, so that accurate placement of the material may be obtained. Laterally extending struts 11*c* extend across the top of the hopper and are attached to the sides of the hopper to provide reinforcement.

The hopper 11 is supported for free standing by a support frame 13 mounted thereto which supports the hopper when the frame is resting on the ground. The frame 13 includes a rectangular base 14 which consists of a pair of straight longitudinal members 14*a*, and a pair of lateral members 14*b* which are affixed to the longitudinal members at the ends thereof. A pair of vertical legs 15 at each end of the hopper 11 extend from attachment at their bottoms to the lateral members 14*b* up to attachment to the hopper 11 to provide vertical support thereto. A lateral buttress leg 16 is attached on each side of the hopper to the longitudinal member 14*a* and extends upwardly and inwardly to attachment to the hopper. For maximum strength and durability, the frame as well as the hopper is formed of high grade structural steel.

As best shown in the top view of FIG. 4, the longitudinal members 14*a* of the base 14 are positioned laterally outward of the longitudinal sides of the rectangular top 11*a* of the hopper 11. The support provided by the longitudinal members 14*a* as transmitted to the hopper 11 through the buttress legs 16, provides substantial lateral stability to my apparatus to prevent accidental tipping when the hopper 11 is filled with material. The outwardly positioned longitudinal members 14*a* also prevent the hopper from engaging and dislodging material from the walls of a deep trench, and allow an operator an extra margin of safety when working between the hopper and the walls of the trench. The support frame 13 firmly supports the hopper 11 in an upright position on the ground, with the bottom opening 11*b* and the guide chute 12 both being above the level of the rectangular base 14 and thus clear of the ground. The hopper 11 may be loaded while it is supported on the ground by the support frame 13, by a front end loader type tractor, which simply scoops up a load of filler material from a pile and discharges it longitudinally into the hopper. Where the longitudinal dimension of the hopper 11 is greater than the width of the bucket or scoop of the end loader, most of the filler material will be retained by the hopper. Overflow or dropped filler material can be readily recovered since it will remain in the vicinity of the pile of filler material and will not be widely dispersed.

The discharge of material from the bottom of the hopper is controlled by the operation of a slide gate 18. As best shown in the cross sectional view of FIG. 5, the slide gate is positioned at the discharge opening 11*b* at the bottom of the guide chute 12, and is mounted for sliding inward and outward movement into a sleeve member 19 which is itself rigidly attached to the bottom of the guide chute 12. The sleeve member 19 has an internal opening 19*a* aligned with and corresponding in dimension to the inside dimension of the guide chute 12 and the discharge opening 11*b* of the hopper. The sleeve member 19 receives the gate 18 for sliding inward and outward movement of the gate across the discharge opening, to selectively cover the discharge opening and control the discharge of filler material therethrough. The gate 18 is movable between a position in which it fully covers the discharge opening to prevent the discharge of filler material, through intermediate positions in which the gate 18 partially covers the discharge opening, to a fully open position in which the gate 18 is clear of the discharge opening and allows the full rate of discharge of filler material. The slide gate 18 is preferably formed as a flat steel plate which slides inwardly and outwardly within the sleeve 19.

Figure 5:
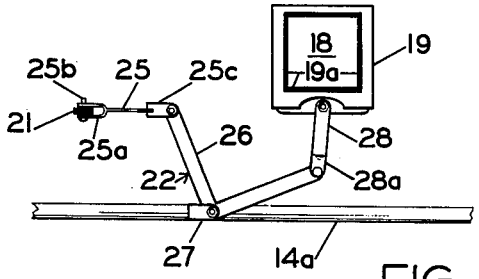
FIG. 5 is a cross-sectional view taken along the line 5—5 of FIG. 3, showing the operation of the slide gate and operating linkage.

The opening and closing of the slide gate 18 is controlled by a manually operated lever 21 which is operatively connected to the slide gate through a linkage 22, with the gate being selectively opened and closed as the lever is moved back and forth. The lever 21 is pivotally attached at a point intermediate its ends to a support bracket 23, which is itself fixedly mounted to the hopper 11, thus allowing rotational movement of the lever with respect to the hopper and support frame. As best shown in FIG. 5, the linkage 22 has a first connecting link 25, with a clevis 25*a* formed on one end thereof which is pivotally attached by means of a pin 25*b* to the lever 21, to thus allow rotation of the lever 21 in the clevis in a vertical plane. The opposite end of the connecting link 25 has a clevis 25*c* formed thereon which extends in a horizontal plane, and which is attached by means of a pin to an L-shaped link 26. The corner of the L-shaped link 26 is pivotally mounted for rotation in a horizontal plane to a support post 27 which extends vertically upward from attachment to one of the longitudinal base members 14*a*. The other end of the L-shaped link 26 is pivotally attached to a stub link 28 by a clevis 28*a* formed on the end thereof having a pin passing through the clevis and through the end of the link 26. The other end of the stub link 28 is pivotally attached to the outside edge of the slide gate 18. It is apparent from FIG. 5 that rotation of the lever 21 such that the connecting link 25 moves toward the slide gate 18, will cause the linkage 22 to draw the slide gate 18 outwardly and open up the discharge opening in the hopper. Rotation of the lever 21 in the opposite direction will, of course, move the slide gate 18 inwardly toward closure of the discharge opening.

In the use of my construction material dispensing apparatus, a back-hoe or other mechanical lifting device such as a power shovel or power arm, may be used to lift the dispensing apparatus into position where an operator may allow the filler material therein to be discharged as desired. To provide a means for suspending the apparatus from an overhanging vertical support such as the bucket of a back-hoe or the like, a hanger 30 is provided at the top of the hopper mounted to a pair of support loops 31 which are themselves mounted on the opposite lateral ends of the hopper 11. The hanger 30 preferably consists of a pair of rigid rods 30*a* which are joined together at their ends which a short rigid stub member 30*b* in a general "Y" shape. The lower ends of the rods 30*a* are preferably loosely looped over the support loops 31 such that the hanger 30 may be rotated from one side of the hopper to the other in a generally vertical direction. A lifting ring 30*c* is connected to the stub member 30*b* at the top thereof and thereby to the rods 30*a*, with the ring 30*c* being adapted to be engaged by a hook or other grasping device, such as the hook 33 shown illustratively in FIG. 1 suspended from a chain 34. The lifting ring is preferably rotationally connected to the stub 30*b* to allow turning of the apparatus 10 when it is suspended from the ring 30*c*. The chain 34 would be attached to a bucket of a back-hoe or power shovel, which is not shown in FIG. 1 for purposes of simplicity. It is preferred that the hanger 30 be of rigid construction as described so that the hanger will fall off to one side, as shown in FIG. 4, to thereby minimize interference of the hanger with the loading of filler material into the hopper. However, it is apparent that the hanger may be otherwise constructed, for example, utilizing flexible chains (not shown) in place of the rigid hanger rods 30*a*.

It is understood that my invention is not limited to the particular construction and arrangement of parts herein illustrated and described, but encompasses all such modified forms thereof as may come within the scope of the following claims.

I claim:

1. Construction filler material dispensing apparatus suspendable from an overhanging vertical support, comprising:

a. a rectangular hopper having an open top and converging downwardly to a discharge opening at the bottom thereof which is substantially smaller than the open top of said hopper, the longitudinal dimension of the top of said hopper being greater than the lateral dimension thereof;

b. a support frame for supporting said hopper having a rectangular base and a plurality of support legs extending upwardly from attachment to said base to attachment to said hopper, said rectangular base including longitudinal members extending laterally outward beyond the rectangular top of said hopper and wherein said support legs include a lateral buttress leg on each side of said hopper attached at their bottoms to said longitudinal members and which extend upwardly and inwardly to attachment to said hopper, whereby said dispensing apparatus has substantial lateral stability when said hopper is supported on the ground by said support frame and said hopper may be maintained away from the sides of a trench by said outwardly extending rectangular base;

c. hanger means for suspending said hopper and frame from an overhanging vertical support when said hanger means is engaged thereto;

d. a slide gate mounted to said hopper at the bottom thereof and movable inwardly and outwardly to selectively cover said hopper bottom opening to control the discharge therethrough of construction filler material contained in said hopper;

e. a lever pivotally mounted to said hopper for rotation in a generally vertical plane; and f. a linkage operatively connected to said lever and to said slide gate such that rotation of said lever about its pivotal mounting moves said slide gate to open or close said hopper bottom opening depending on the direction of rotation of said lever.

2. The material dispensing apparatus of claim 1 including a sleeve member having an internal opening aligned with said discharge opening, said sleeve member being mounted at the bottom of said hopper, said slide gate being slidingly movable in said sleeve member to selectively cover said hopper bottom opening to control the discharge of filler material therethrough.

3. The material dispensing apparatus of claim 1 wherein said hanger means includes a pair of rigid hanger rods joined together at one of the ends thereof, wherein said hopper has a pair of rigid support loops attached thereto at the opposite lateral ends of said hopper and wherein the other ends of said hanger rods are mounted to said support loops to provide vertical support thereto while allowing said hanger rods to rotate about said support loops in a vertical direction of rotation, said hanger means also including a lifting ring connected to the joined ends of said hanger rods whereby said lifting ring can be engaged by a support hook suspended from a crane or the like to suspend said hopper and frame from said hanger means.

4. The material dispensing apparatus of claim 1 wherein the open top of said hopper has a longitudinal dimension of at least six feet.

* * * * *